US005499817A

United States Patent [19]

Brady

[11] Patent Number: 5,499,817

[45] Date of Patent: Mar. 19, 1996

[54] TRAINING METHOD FOR ACHIEVING A REPEATABLE PUTTING STROKE

[76] Inventor: Londa B. Brady, 436 Homer Ave., Longwood, Fla. 32750

[21] Appl. No.: 257,655

[22] Filed: Jun. 9, 1994

[51] Int. Cl.[6] ..... A63B 69/36

[52] U.S. Cl. ..... 273/194 R; 273/187.4; 273/192

[58] Field of Search ..... 273/194 A, 194 R, 273/193 R, 192, 191 R, 186.2, 187.4, 163 A

[56] References Cited

U.S. PATENT DOCUMENTS

| | | | |
|---|---|---|---|
| 1,644,392 | 10/1927 | Myers | 273/194 R |
| 3,194,564 | 7/1965 | Swan | 273/194 A |
| 3,198,525 | 8/1965 | Smith | 273/163 |
| 3,253,829 | 5/1966 | Ford | 273/163 |
| 3,262,705 | 7/1966 | Nunziato | 273/163 |
| 3,273,892 | 9/1966 | Nolting | 273/163 |
| 3,273,893 | 9/1966 | Duncan | 273/163 |
| 3,298,693 | 1/1967 | Eisenberg | 273/163 |
| 3,424,462 | 1/1969 | Driscoll | 273/194 R |
| 3,495,834 | 2/1970 | Tanczos | 273/163 |
| 4,174,838 | 11/1979 | Paschetto | 273/163 A |
| 4,647,045 | 3/1987 | Bilyeu | 273/163 A |
| 4,789,158 | 12/1988 | Chiesa | 273/163 A |
| 4,949,971 | 8/1990 | Thornton | 273/186 A |
| 4,953,867 | 9/1990 | Rigsby | 273/183 D |
| 5,143,376 | 9/1992 | Johnson | 273/186.2 |

FOREIGN PATENT DOCUMENTS

| | | | |
|---|---|---|---|
| 14608 | of 1905 | United Kingdom | 273/163 A |

*Primary Examiner*—Mark S. Graham

*Attorney, Agent, or Firm*—Allen, Dyer, Doppelt, Franjola & Milbrath

[57] ABSTRACT

A training method for achieving a repeatable putting stroke incorporates an elongated rod affixed to a shaft of a putter. The putter head displaced from the ball while keeping a separation distance between the elongated rod and a plane passing through the ball. By repeating straight back and straight forward stroking of the ball while maintaining the separation distance, a repeatable putting stroke is achieved. Once achieved, the elongated rod is removed from the putter shaft for repeating the straight back and straight forward stroke developed from the feel using the elongated rod. Attachment rod is provided in an alternate embodiment for aligning the elongated rod perpendicular to the putter face. Indicia are placed on the elongated rod for providing a measurement of a displacement distance between the putter head and the ball during the straight back stroking portion. With such a device and training method, repeatable putting stroke is achieved.

18 Claims, 3 Drawing Sheets

TRAINING METHOD FOR ACHIEVING A REPEATABLE PUTTING STROKE

BACKGROUND OF INVENTION

1. Field of Invention

The invention relates generally to the golf putting stroke and particularly to a training method for achieving a repeatable putting stroke.

2. Background Art

Golf club aiming and aligning devices are well-known and such devices and methods are generally concerned with aligning the face of a golf club at a right angle with a straight line running between the cup or hole and the center of the golf ball. A variety and complexity of devices have been introduced and focused primarily on teaching aiming or citing of the club to a given target. Typical devices provide a method for citing to a target during practice or even on the golf course during play.

U.S. Pat. No. 4,949,971 issued to C. J. Thornton on Aug. 21, 1990 discloses a golf training aid having a rotatable t-shaped pointer mounted to a block that encircles the shaft of a golf club. The Thornton '971 patent discloses a golf training aid for providing proper positioning of a golf club in relation to a hole wherein the device has a direction pointer that can be moved relative to the block that grips the club shaft. U.S. Pat. No. 3,495,834 issued to O. S. Tanczos on Feb. 17, 1970 discloses a golf club pointer that is secured to the shank of a golf club with the pointer member being swingably secured to the shank for movement between a position parallel to the shank and a position extending right angles to the shank and thus the face of the golf club head. The Tanczos '834 patent discloses a highly reflective side of the golf club aiming device in order that the person using the device can see the pointer during a high speed swing of the golf head. The straight guide portion of the device is adapted to extend at a right angle to the face of the golf club head along a line disposed just above the center of the head face. U.S. Pat. No. 3,273,893 issued to J. B. Duncan on Sep. 20, 1966 discloses a putt aligning device that enables the golfer to align the putter blade while the ball is being sighted. The Duncan '893 patent seeks to satisfy the need for a device that is convenient to use and easily installed in a working position, easily disconnected, economical to make and relatively simple in order to encourage the use and operation of the device.

The above references, a sample only, are a few of many that deal particularly with devices that are easily attached to and removed from the shaft of a golf club putter to be used during practice or play for teaching the proper use for alignment of the putter head with the ball and target. Along with the above references, more golf instruction has been written about putting than any other stroke. For one reason, putting is probably the most individualistic of golf shots. A variety of stances, swings and even grips can be observed on the professional tour as well as during the viewing of a weekend golf match. Putting instructions include teaching to accelerate the putting stroke to get the ball to the hole, having a firm stroke especially during long putts and placement of the ball in relation to your feet. Typically, such teachings do not include placement of devices on the putter, especially during play. It would therefore be an improvement to develop a simple, lightweight, detachable device which did not focus on aiming or sighting or interfere with the normal visibility of the ball at normal address. It would be an improvement to provide the player with an inexpensive, easy-to-use device to develop a consistently smooth stroke not dependent upon a target and not dependent upon anything but the putter in his hands during play. Accordingly, a need exists for a training method to achieve a repeatable putting stroke.

SUMMARY OF INVENTION

A training method for achieving a repeatable putting stroke includes providing an elongated rod having proximal and distal ends and removably affixing the rod proximal end to a shaft of a putter proximate the putter head. The rod is aligned at an angle perpendicular to the ball striking face and typically at a separation distance from a plane passing through a reference point on a ball positioned for being struck by the putter face. The ball is positioned being struck by the face and the putter head is displaced from the ball while keeping the separation distance between the rod and the plane substantially constant. The ball is struck while maintaining the separation distance thereby keeping the ball center within the plane perpendicular to the face. The method further comprises the steps of continuing the placing, displacing and striking steps a multiplicity of times sufficient for repeating such steps to achieve a straight back and straight forward stroke. Once achieved, the elongated rod is removed from the putter shaft. The putter face is placed proximate a golf ball to be struck and perpendicular to a plane passing through a center of the ball. The putter head is displaced from the ball while holding a distance between the ball reference point and an imaginary plane passing through the shaft substantially constant. The shaft plane is perpendicular to the ball striking face. The ball is struck by stroking the head toward the ball while continuing to maintain the separation distance substantially constant thereby achieving a straight back and straight forward stroke after having established such a stroke using the elongated rod.

In an alternate method, an attachment rod is rotatably affixed perpendicular to the elongated rod proximal end for rotating the attachment rod within a plane perpendicular to the elongated rod. The attachment rod is placed proximate the putter face for aligning the attachment rod parallel to the putter face thereby placing the elongated rod perpendicular to the face. The method further comprises the steps of rotated the attachment rod away from the putter face to a position proximate the shaft for storage.

It is an object of the invention to provide a practice and training device to develop a smooth, consistent and controlled stroke typically required for putting. It is further an object of the invention to teach such a training method using a device which is not dependent upon alignment with a target and can be used on a regular basis on the practice green or during play. It is further an object to provide such a device that is lightweight so as not to effect the use of the putter with or without the device, and easily adaptable to putters currently seen in the marketplace. It is an object of the invention to provide a method for maintaining a straight back and straight through putting stroke. Keeping the users head still and focused on the ball and device during practice so as to aid in developing a feel for distance based on the relationship of the length of the backstroke to the distance the ball will travel when struck subsequently attaining such a stroke when the training device is removed from the putter. It is further an object of the invention to provide a training technique supported by a device that can be manually adapted to the typical putter and either stored or removed during play when desired.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 2:
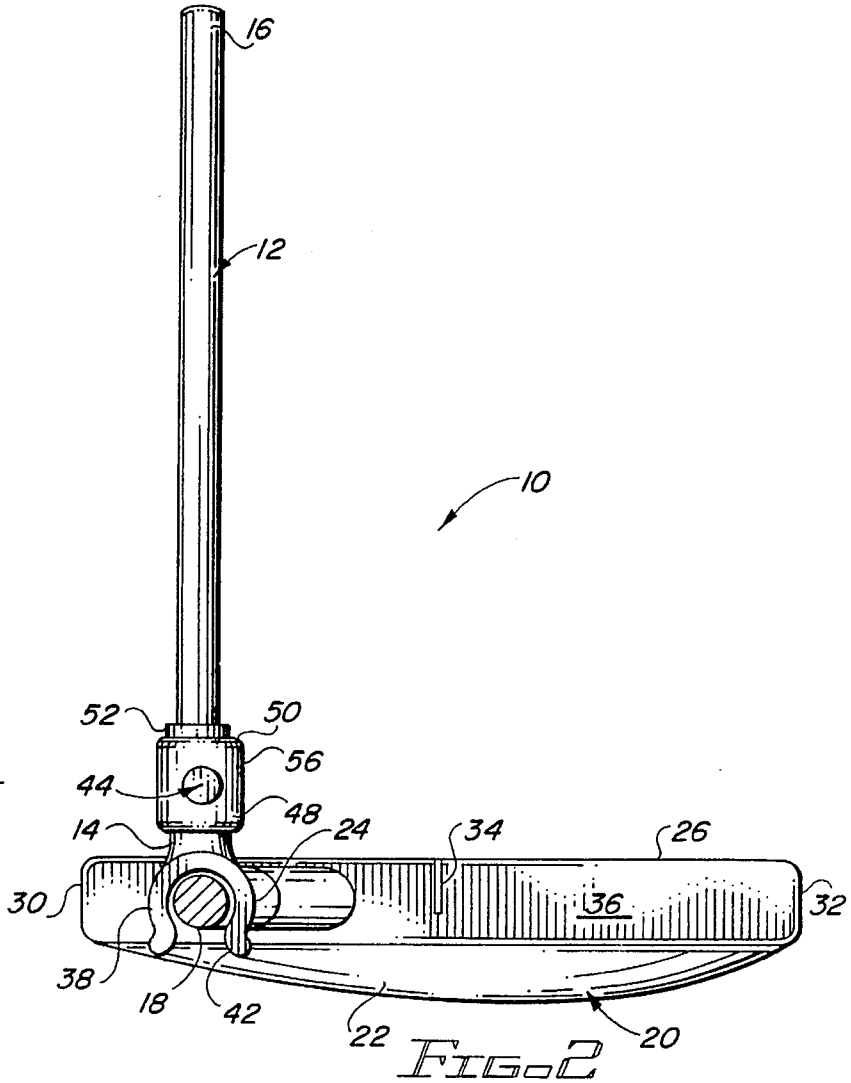
FIG. 2 is a partial top view of the device of FIG. 1 illustrating an attachment rod rotated about an elongated rod into a storage position.

The present invention teaches a training method for achieving a repeatable putting stroke wherein the method incorporates a training device 10 as will be described with reference to FIG. 1. The device 10 comprises an elongated rod 12 having a proximal end 14 and a distal 16 end. The proximal end 14 is adapted to be rotatably affixed to a shaft 18 of a putter 20 as is well-known in the art, the putter 20 comprises a putter head 22 affixed to the shaft 18 at a hossle 24. The putter head 22 comprises a face 26 for striking a golf ball 28 as will be further described with reference to FIGS. 3*a* through 3*c*. As is also typical, the putting face 26 runs across putter head 22 from heal 30 to toe 32 and often time comprises an alignment score line 34 affixed to a putter head top visible 36. The score line 34 indicating the preferred location on the putter face 26 for striking the ball 28.

In the preferred embodiment of the training device 10, a resilient split sleeve 38 having a bore 40 for receiving the shaft 18 is integrally formed to the elongated rod proximal end 14 for affixing the rod 12 to the shaft 18 as illustrated with reference to FIG. 1. The resilient split sleeve 38 sufficiently flexible to permit the shaft 18 to pass through a slit 42 in the sleeve 38 and into the bore 40 while provide sufficient biasing against the shaft 18 to hold the elongated rod 12 in a fixed position.

Figure 1:
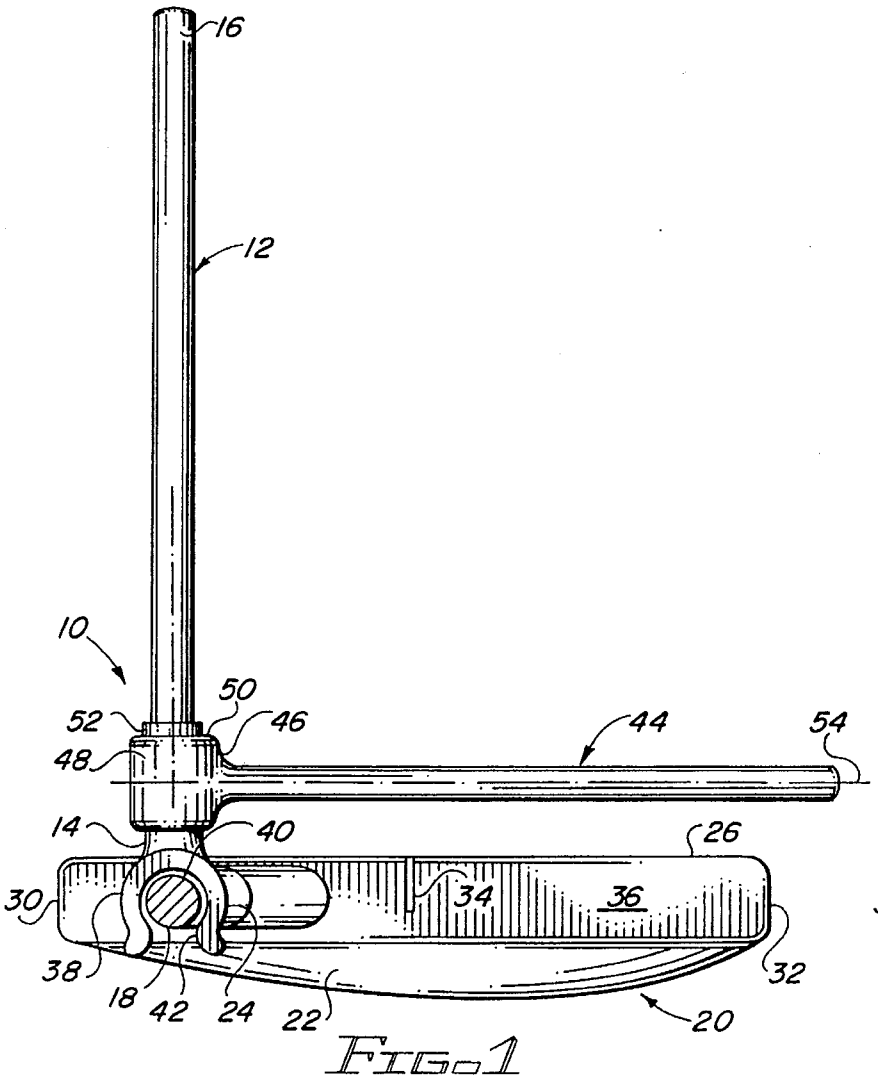
FIG. 1 is a partial top view of the preferred embodiment of the present invention illustrating use with a typical golf club putter.

With further reference to FIG. 1, an ultimate embodiment of the present invention includes rotatably affixing an attachment rod 44 proximate the elongated rod proximal end 14. In the preferred embodiment of the present invention, the attachment rod 44 comprises a proximal end 46 having a sleeve 48 integrally affixed to the attachment rod proximal end 46. The sleeve 48 comprises a bore 50 for rotatably receiving a portion 52 of the elongated rod proximal end 14. As will be described later with reference to the training method, the attachment rod 44 can thus be rotated into a position first parallel to the putter head 26 and later proximate the shaft 18 for storage. As again illustrated with reference to FIG. 1, with such an arrangement as herein described, the attachment rod 44 is rotatable but the elongated rod 12 in a first imaginary plane 54 perpendicular to the elongated rod 12. With reference to FIG. 2, the attachment rod 44 can thus be placed in a storage position 56 wherein the attachment rod 44 is generally parallel to the shaft 18.

Figure 3A:
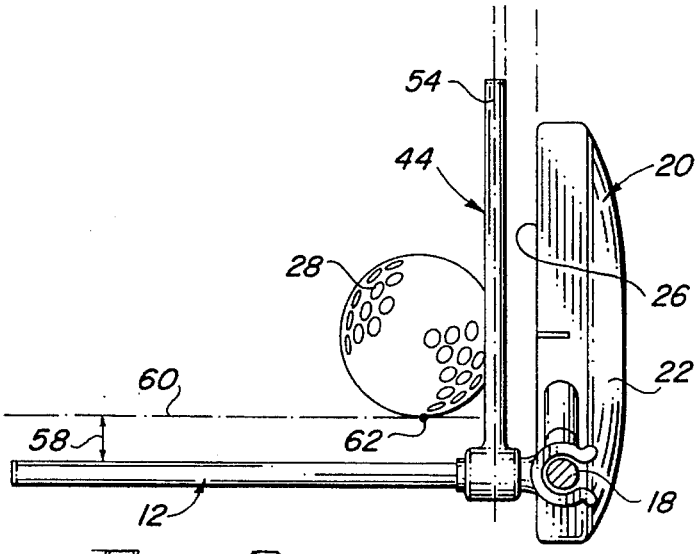
FIGS. 3*a* through 3*c* illustrate the device used in the present invention at various locations during positioning and stroking of a golf ball.
Figure 3B:
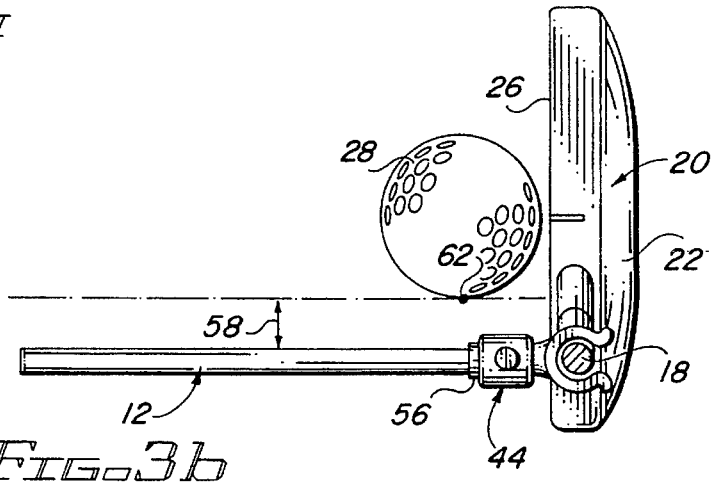
Figure 3C:
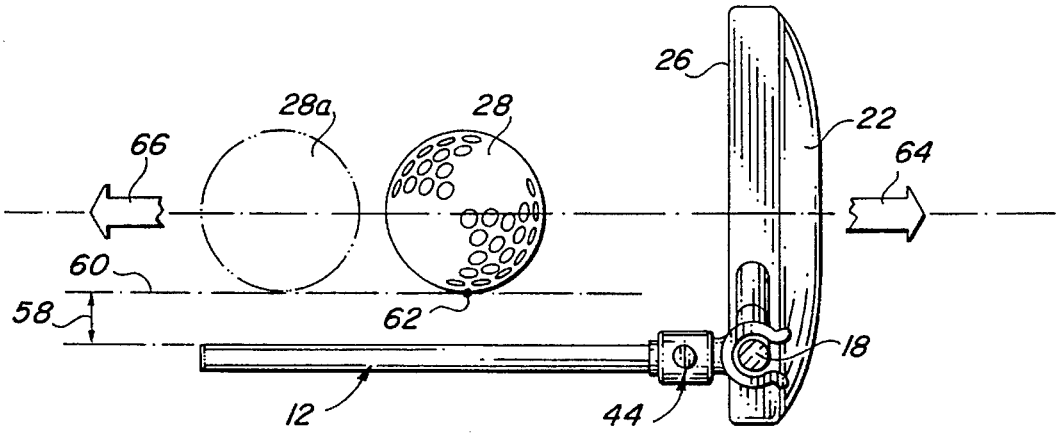

With such an arrangement as herein described, the training method for achieving a repeatable putting stroke provided with reference to FIGS. 3*a*, 3*b* and 3*c*. The elongated rod 12 is rotatably affixed to the shaft 18 as earlier described. The elongated rod 12 is generally rotatable in a plane (not shown) perpendicular to the shaft 18. The elongated rod rotated into a position wherein the rod 12 is perpendicular to the putter face 26. Typically, and as illustrated by way of example with reference to FIGS. 3*a* through 3*c*, the rod 12 thus placed at a separation distance 58 from a plane 60 passing through a reference point 62 on the ball 28. By way of example, the reference point 62 is a tangent point on the ball surface proximate the elongated rod 12.

To aid in the placement of the elongated rod 12 at a position perpendicular to the putter face 26, the attachment rod 44, as earlier described, is used in combination with the elongated rod 12. Again with reference to FIG. 3*a*, the attachment rod 44 is rotatably affixed to the elongated rod 12 as earlier described for rotation within the plane 54 perpendicular to the elongated rod 12. The attachment rod 44 is rotated into a position proximate the putter face 26 and the elongated rod 12 is rotated about the shaft 18 to place the attachment rod 44 and thus the plane 54 parallel to the putter head face 26. As illustrated with reference to FIG. 3*b*, once the attachment rod 44 is parallel to the putter head face 26, the attachment rod 44 is rotated about the elongated rod proximal end 14 into a position proximate generally parallel to the shaft 18. With such a step, the attachment rod 44 has completed the function of aligning the elongated rod in a position perpendicular to the putter head face 26.

With the elongated rod 12 in its position perpendicular to the club face 26, as illustrated in FIG. 3*b*, the putter head 22 is displaced from the ball 28 in the back stroke position 64, as illustrated in FIG. 3*c*, while maintaining separation distance 58 between the elongated rod 12 and ball reference plane 60. Once the back stroke 64 is completed, the putter head 22 is brought toward the ball in the forward stroke 66 again while maintaining separation distance 58 to a point where the putter face 26 strikes the ball 28 and sends it on its way 28*a* away from the putter face 26 as illustrated with reference to FIG. 3*c*.

In the preferred embodiment of the invention, the above steps of the placing, displacing and striking of the ball a multiplicity of times is repeated a sufficient number of times to achieve a feel for a straight back 64 and straight forward 66 stroke. With the device be in place, separation distance 58 is observed and used as an aid in establishing the repeating nature of the striking steps. Once a feeling for the stroke is achieved, the device 10 is removed from the putter shaft 18. The putter face 26 is again placed proximate the golf ball 28 to be struck and the putter head is displaced from the ball to achieve the straight back and straight forward stroke while holding the separation distance 58 between the ball reference point 62 or plane 6e and an imaginary plane (not shown) passing through the shaft where the elongated rod 12 would have been placed when in its position as earlier described. With the thought of maintaining the separation distance 58 established through the repeated steps using the device 10, the goal of achieving a straight back and straight forward stroke is accomplished.

Figure 5:
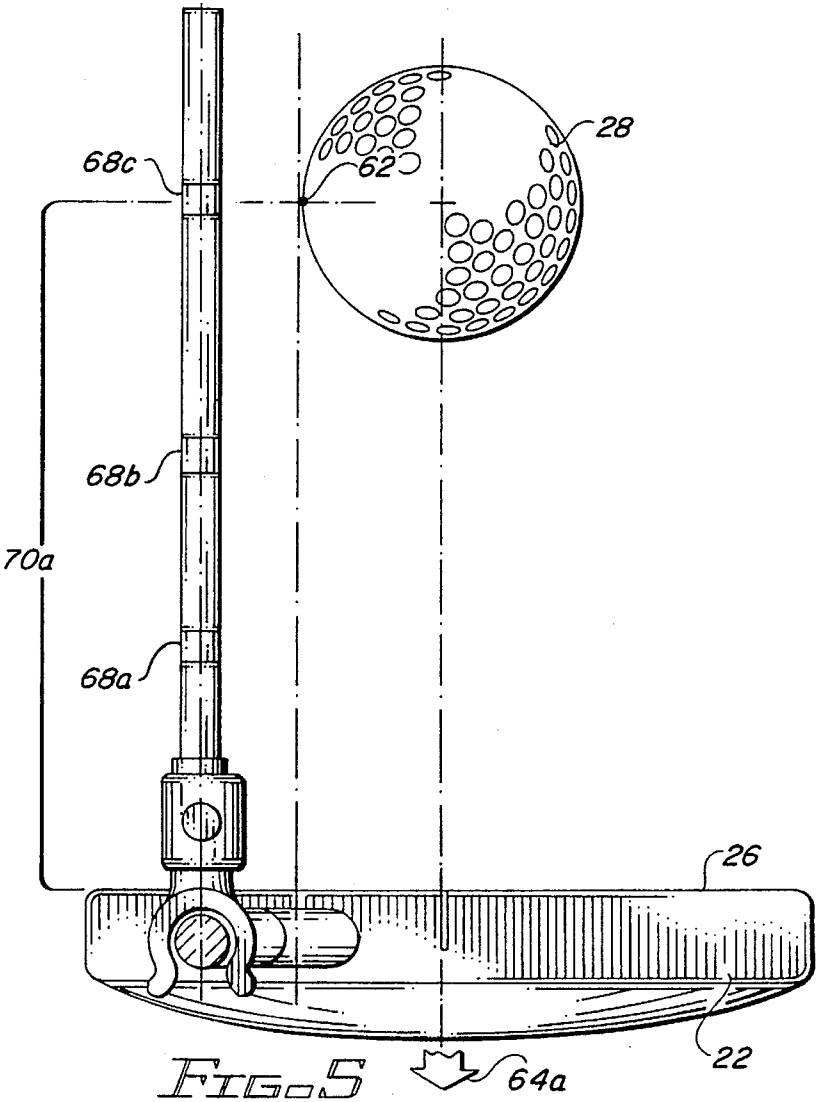
FIG. 5 is a partial top view of the device as illustrated in FIG. 4 illustrating displacement of the putter head away from golf ball.
Figure 4:
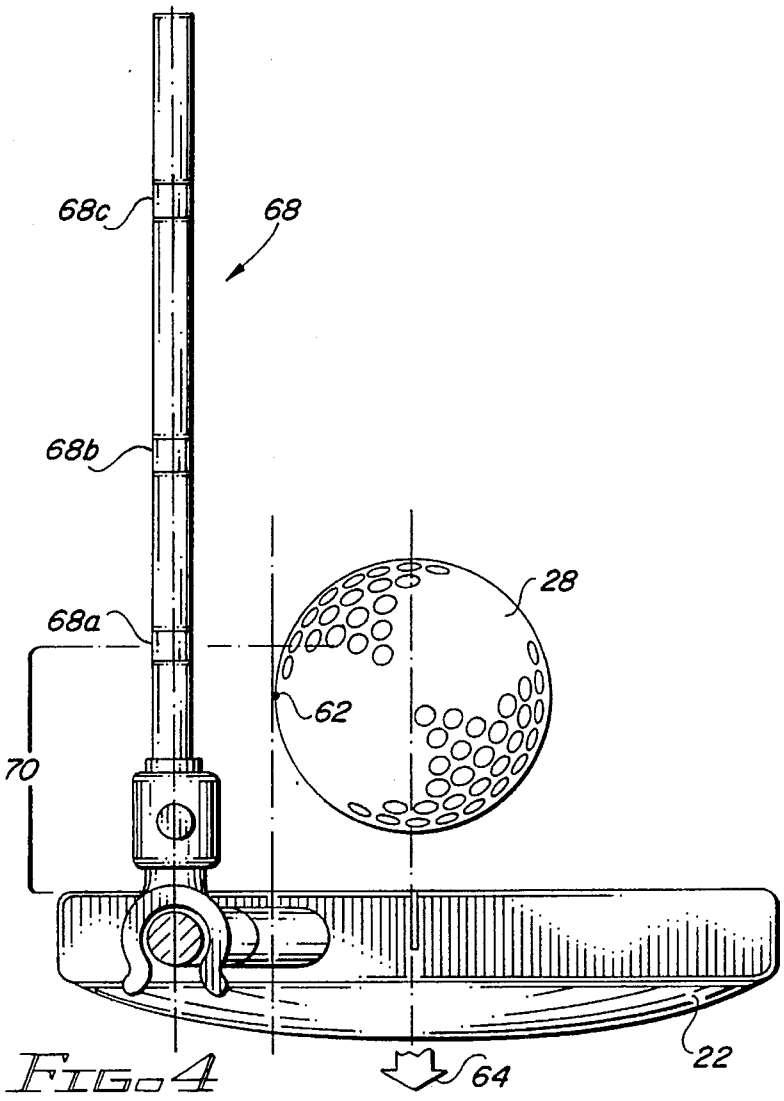
FIG. 4 is a partial top view of a putter and the training device illustrating positioning with a golf ball to be struck relative to an elongated rod having indicia attached thereto.

With reference to FIGS. 4 and 5, training method is further expanded to include affixing a multiplicity of indicia 68 through the elongated rod. The indicia 68 whether in the form of lettering or marks shown by way of example are uniformly positioned between the elongated rod proximal end 14 and distal end 16 for the purpose of measuring a displacement distance 70 between a ball 28 positioned for being struck by the putter face 26. As illustrated with reference to FIGS. 4 and 5, the putter head 22 is brought back 64 to a displacement position 70 away from the ball 28 while using a first indicium 68*a* in relation to a reference point 62 on the ball or some arbitrary point away from the reference point 62. The putter head is then brought to the forward stroke position to strike the ball 28. As illustrated with reference to FIG. 5, the club head 22 is brought to an alternate back stroke position 64*a* producing displacement distance 70*a* between the putter face 26 and a reference point 62 by way of example. Indicium 68*c* is used to identify displacement distance 70*a* by way of this example. Such a displacement distance 70*a*, the putter head 22 and thus face 26 are then brought towards the ball 28 in a striking fashion as earlier described resulting in a ball 28 struck so as to travel relative distance based on stroke 64*a* using the displacement distance 70*a* plus displacing steps incorporating the multiplicity of indicia 68 provide predetermined displacements and thus predetermined impact between the putter face 26 and the ball 28 resulting in predetermined travel distances for the ball 28. With the repeating philosophy as earlier described, the putter head can be displaced again while maintaining separation distance 58 as earlier described but with the added feature of incorporating a displacement distance 70 to promote not only the repeated forward and back stroke necessary to properly strike a golf ball but a back stroke providing a displacement distance 70 between the putter face 26 and the ball 28 sufficient to cause the ball 28 to travel a predetermined distance along a putting surface.

As is often stated, "practice! Practice! Practice!" important in achieving any repeating motion, especially the motion of the putting stroke. However, as has been taught with the present invention, the straight back and straight through putting stroke is important to the proper stroking of the golf ball and the use of the device 10 to develop a "feel" taking it to a practice green and determining how much of a back stroke 64 equal a given distance for the put can be achieved with the embodiment and teachings of the present invention.

While a specific embodiment of the invention has been described along with alternate embodiments, it is to be understood that various modifications may be made the specific details described herein without departing from the spirit and scope of the invention. Having now described the invention, the construction, the operation and use of preferred embodiments thereof, the advantageous new and useful results obtained thereby, the new and useful constructions, methods of use and reasonable mechanical equivalents thereof obvious to those skilled in the art, are set forth in the appended claims.

What is claimed is:

1. A training method for achieving a repeatable putting stroke, the method comprising the steps of:

providing an elongated rod having proximal and distal ends;

removably affixing the elongated rod proximal end to a shaft of a putter proximate a putter head, the head having a ball striking face;

providing an attachment rod having proximal and distal ends;

rotatably affixing the attachment rod proximal end to the elongated rod proximal end for rotating the attachment rod within a plane perpendicular to the elongated rod;

placing the attachment rod proximate the putter face;

aligning the attachment rod parallel to the putter face thereby placing the elongated rod; perpendicular to the ball striking face for placing the elongated rod at a separation distance from a plane passing through a reference point on a ball positioned for being struck by the putter face;

placing the putter face proximate a golf ball;

positioning the ball for being struck by the putter face, the putter face perpendicular to a plane passing through a center of the ball;

displacing the putter head from the ball while keeping the separation distance substantially constant; and striking the ball by stroking the putter face toward the ball while maintaining the separation distance substantially constant thereby keeping the ball center within the plane perpendicular to the face.

2. The method as recited in claim 1, wherein the putter shaft is offset from a ball striking area on a surface of the head and the attachment rod aligning step comprises the step of aligning the elongated rod perpendicular to the face thereby displacing the elongated rod at a separation distance from a plane passing through a point tangent a ball positioned for being struck by the putter face.

3. The method as recited in claim 1 wherein the elongated rod affixing step further comprises the steps of:

providing a resilient split sleeve having a bore dimensioned for holding a putter shaft, the sleeve having a split extending along a wall of the sleeve dimensioned for passing the shaft through the split into the bore; and affixing the sleeve to the elongated rod proximal end for removably affixing the elongated rod proximal end to the shaft.

4. The method as recited in claim 1, further comprising the step of rotating the attachment rod away from the putter face to a position proximate the shaft for storage.

5. The method as recited in claim 1, wherein the attachment rod affixing step comprising the steps of:

providing an attachment sleeve having a cylindrical bore for receiving a cylindrical portion of the elongated rod proximal end, the bore axis dimensioned for aligning with an axis of the rod cylindrical portion for permitting rotation of the rod within a plane perpendicular to the rod;

affixing the attachment sleeve to the attachment rod proximal end; and placing the elongated rod proximal end within the attachment sleeve bore for rotating from a first position proximate the putter head face for aligning the attachment rod parallel to the face to a second position proximate the putter shaft for storage during the ball striking step.

6. The method as recited in claim 1, further comprising the step of affixing indicia to the elongated rod positioned between the elongated rod proximal and distal ends.

7. The method as recited in claim 6, wherein the displacing step further comprises the step of displacing the putter head from the ball for aligning one indicium proximate the ball thereby providing a predetermined displacement.

8. The method as recited in claim 6, wherein the indicia comprise advertising.

9. The method as recited in claim 1, further comprising the steps of:

continuing the placing, displacing and striking steps a multiplicity of times sufficient for repeating the displacing and striking steps to achieve a straight back and straight forward stroke;

removing the elongated rod from the putter shaft;

placing the putter face proximate a golf ball positioned for being struck by the putter face, the putter face perpendicular to a plane passing through a center of the ball;

displacing the putter head from the ball while holding a distance between the ball reference point and an imaginary plane passing through the shaft substantially constant, the shaft plane perpendicular to the ball striking face; and striking the ball by stroking the head toward the ball while continuing to maintain the separation distance substantially constant thereby achieving a straight back and straight forward stroke.

10. The method as recited in claim 1, wherein the placing step comprises the step of placing the putter face proximate a golf ball positioned for striking a sweet spot of the putter face.

11. A training method for achieving a repeatable putting stroke, the method comprising the steps of:

providing a putter having a head and a shaft affixed to the head, the head having a ball striking face;

providing an elongated rod having proximal and distal ends;

removably affixing the rod proximal end to the putter shaft for positioning the rod in a line of sight location between a golf ball positioned to be struck by the putter face and a golfer positioned to strike the ball;

providing an attachment rod having proximal and distal ends;

rotatably affixing the attachment rod proximal end to the elongated rod proximal end for rotating the attachment rod within a plane perpendicular to the elongated rod;

placing the attachment rod within an imaginary plane parallel to the putter face thereby placing the elongated rod perpendicular to the ball striking face, the elongated rod extending outward from the face;

providing a golf ball resting on a surface sufficient for rolling the golf ball;

placing the putter face proximate the golf ball thereby positioning the ball for being struck by the putter face;

aligning the putter face perpendicular to an imaginary plane passing through the ball thereby forming a separation distance between the ball imaginary plane and a parallel plane passing through the rod;

displacing the putter face from the ball while keeping the rod within the rod parallel plane thereby maintaining a constant separation distance between the ball and the rod; and striking the ball by stroking the putter face toward the ball while substantially maintaining the constant separation distance thereby causing the putter face to strike the ball while keeping the face perpendicular to the ball center plane.

12. The method as recited in claim 11, wherein the putter shaft is offset from a preferred ball striking area on a surface of the face and the attachment rod aligning step thereby displaces the elongated rod at a separation distance from a plane passing through a point tangent the ball positioned for being struck by the putter face.

13. The method as recited in claim 11, further comprising the step of rotating the attachment rod away from the putter face to a position proximate the shaft for storage during a putting stroke.

14. The method as recited in claim 11, further comprising the step of affixing a multiplicity of indicia to the elongated rod, the indicia positioned between the elongated rod proximal and distal ends for measuring a displacement distance between a ball positioned for being struck by the putter face and the putter face, the displacement distance indicative of an impact with which the ball is struck.

15. The method as recited in claim 14, wherein the displacing step further comprises the step of displacing the putter head from the ball for aligning one indicium proximate the ball thereby providing a predetermined displacement from which to strike the ball and thus a resulting distance of travel for the ball.

16. The method as recited in claim 11, further comprising the steps of:

continuing the placing, displacing and striking steps sufficient for establishing a straight back and straight forward stroke;

removing the elongated rod from the putter shaft;

placing the putter face proximate a golf ball positioned for being struck by the putter face, the putter face perpendicular to a plane passing through a center of the ball;

displacing the putter head away from the ball while holding a distance between the ball reference point and the rod imaginary plane parallel to the ball center imaginary plane;

striking the ball by stroking the head toward the ball while continuing to maintain the planes parallel thereby keeping the straight back and straight forward stroke.

17. The method as recited in claim 11, wherein the placing step comprises the step of placing the putter face proximate a golf ball positioned for striking a sweet spot of the putter face.

18. A training method for achieving a repeatable putting stroke, the method comprising the steps of:

providing an elongated rod having proximal and distal ends;

removably affixing the elongated rod proximal end to a shaft of a putter proximate a putter head, the head having a ball striking face;

providing an attachment rod having proximal and distal ends;

rotatably affixing the attachment rod proximal end to the elongated rod proximal end for rotating the attachment rod within a plane perpendicular to the elongated rod;

placing the attachment rod proximate the putter face;

aligning the attachment rod parallel to the putter face thereby placing the elongated rod perpendicular to the ball striking face for placing the elongated rod at a separation distance from a ball positioned for being struck by the putter face;

rotating the attachment rod away from the putter face to a position proximate the shaft for storage during the putting stroke;

placing the putter face proximate a golf ball;

positioning the ball for being struck by the putter face, the putter face perpendicular to a plane passing through a center of the ball;

displacing the putter head from the ball while keeping the separation distance substantially constant; and striking the ball by stroking the putter face toward the ball while maintaining the separation distance substantially constant thereby keeping the ball center within the plane perpendicular to the face.

* * * * *